US010614735B2

(12) United States Patent
Zeng

(10) Patent No.: US 10,614,735 B2
(45) Date of Patent: Apr. 7, 2020

(54) FLEXIBLE GOA DISPLAY PANEL AND METHOD OF MANUFACTURING THE SAME

(71) Applicant: SHENZHEN CHINA STAR OPTOELECTRONICS SEMICONDUCTOR DISPLAY TECHNOLOGY CO., LTD., Shenzhen, Guangdong (CN)

(72) Inventor: Mian Zeng, Guangdong (CN)

(73) Assignee: SHENZHEN CHINA STAR OPTOELECTRONICS SEMICONDUCTOR DISPLAY TECHNOLOGY CO., LTD., Shenzhen (CN)

( * ) Notice: Subject to any disclaimer, the term of this patent is extended or adjusted under 35 U.S.C. 154(b) by 0 days.

(21) Appl. No.: 15/741,083

(22) PCT Filed: Nov. 21, 2017

(86) PCT No.: PCT/CN2017/112055
§ 371 (c)(1),
(2) Date: Sep. 27, 2018

(87) PCT Pub. No.: WO2019/090819
PCT Pub. Date: May 16, 2019

(65) Prior Publication Data

US 2019/0139473 A1 May 9, 2019

(30) Foreign Application Priority Data

Nov. 9, 2017 (CN) ..... 2017 1 1098626

(51) Int. Cl.
*G09G 3/20* (2006.01)
*G09F 9/30* (2006.01)

(52) U.S. Cl.
CPC ..... *G09G 3/20* (2013.01); *G09F 9/301* (2013.01); *G09G 2300/0408* (2013.01); *G09G 2310/0281* (2013.01); *G09G 2380/02* (2013.01)

(58) Field of Classification Search
CPC ..... G09G 3/20; G09G 2310/0281; G09G 2380/02; G09G 2300/0408; G09F 9/301
See application file for complete search history.

(56) References Cited

FOREIGN PATENT DOCUMENTS

CN 106409149 A 2/2017

*Primary Examiner* — Aneeta Yodichkas
(74) *Attorney, Agent, or Firm* — Hemisphere Law, PLLC; Zhigang Ma

(57) ABSTRACT

This invention provides a flexible GOA display panel and a method of manufacturing the same. The flexible GOA display panel comprises a display area having at least one foldable region, multiple rows of pixel units disposed in the display area, and multiple GOA circuit units disposed in non-foldable regions on opposite sides of the display area, each of the GOA circuit units being used for driving pixel units in a corresponding row. All the GOA circuit units have a same height which is smaller than a pixel unit height, so that the distribution of the GOA circuit units can be away from the foldable region. Moreover, the resistances of the lines from the outputs of the GOA circuit units to the pixel units in corresponding rows are the same so as to reduce influence of the foldable region to the characteristic and reliability of the flexible GOA panel.

10 Claims, 4 Drawing Sheets

FLEXIBLE GOA DISPLAY PANEL AND METHOD OF MANUFACTURING THE SAME

RELATED APPLICATIONS

The present application is a National Phase of International Application Number PCT/CN2017/112055, filed Nov. 21, 2017, and claims the priority of China Application No. 201711098626.0, filed Nov. 9, 2017.

FIELD OF THE DISCLOSURE

The disclosure relates to a field of display technology, and more particularly to a flexible GOA display panel and method of manufacturing the same.

BACKGROUND

A flexible display device has become a research hot spot in display field due to its fold ability, shock acceptance, convenience to wear and other characteristics. However, in the action of folding, circuits in a foldable region of the flexible display panel may be damaged, which in turn reduces the life of the circuits in the foldable region, cause the circuits in the foldable region to be disconnected, and affects the display effect of the entire flexible display panel.

As shown in FIG. 1 and FIG. 2, a conventional GOA (Gate Drive IC on Array) display panel includes a display area 1' having a foldable region 2', a plurality of rows of pixel units disposed in the display area 1', and multiple GOA circuit units 3' on opposite sides of the display area 1'. Each of the GOA circuit units 3' corresponds to each row of pixel units in the display area 1'. Each pixel unit includes three primary color sub-pixels 11', 12', and 13'. The GOA circuit unit 3' has a height equal to the height Hp of the pixel unit. The GOA circuit unit has many components and its component density is also very large. As shown in FIG. 1, if the GOA circuit unit is arranged in the foldable region 2', its performance will certainly be affected, and the life time and production yield of the display panel and so on will also be affected.

SUMMARY

The technical problem to be solved by the present invention is to provide a flexible GOA display panel and a method of manufacturing the same, so as to avoid influence of a folded region on the GOA circuit unit.

In order to solve the above technical problem, the present invention provides a flexible GOA display panel, comprising:

a display area having at least one foldable region;

multiple rows of pixel units disposed in the display area; and multiple GOA circuit units disposed in non-foldable regions on opposite sides of the display area, each of the GOA circuit units being used for driving pixel units in a corresponding row; wherein all the GOA circuit units have a same height and the height is smaller than a pixel unit height.

The height of the GOA circuit unit is equal to Hp−Hf/a, wherein Hf refers to the height of the foldable region, Hp refers to the height of the pixel unit, and a refers to the number of rows of the pixel units in the display area.

The resistances of the lines between the output terminals of respective GOA circuit units and the gate lines of the pixel units in corresponding rows are the same.

The foldable region is provided with a plurality of rows of dummy GOA circuit units.

The height of the dummy GOA circuit unit is equal to the height of the GOA circuit unit.

The present invention further provides a method of manufacturing a flexible GOA display panel, comprising steps of:

providing multiple rows of pixel units in a flexible substrate to from a display area;

providing a foldable region in the flexible substrate; and providing multiple GOA circuit units in non-foldable regions on opposite sides of the display area, each of the GOA circuit units being used for driving pixel units in a corresponding row; wherein all the GOA circuit units have a same height and the height is smaller than a pixel unit height.

The height of the GOA circuit unit is equal to Hp−Hf/a, wherein Hf refers to the height of the foldable region, Hp refers to the height of the pixel unit, and a refers to the number of rows of the pixel units in the display area.

The resistances of the lines between the output terminals of respective GOA circuit units and the gate lines of the pixel units in corresponding rows are the same.

The manufacturing method further comprises a step of providing a plurality of rows of dummy GOA circuit units in the foldable region.

The height of the dummy GOA circuit unit is equal to the height of the GOA circuit unit.

The embodiment provided by the present invention has the following effect. First, the height of the GOA circuit unit is redesigned. The height of conventional GOA circuit unit which is equal to the height of pixel unit is reduced so that the distribution of the GOA circuit units can be away from the foldable region. Second, the resistances of the lines from the outputs of the GOA circuit units to the pixel units in corresponding rows are the same. The influence of the foldable region to the characteristic and reliability of the whole flexible GOA panel is reduced.

BRIEF DESCRIPTION OF THE DRAWINGS

Accompanying drawings are for providing further understanding of embodiments of the disclosure. The drawings form a part of the disclosure and are for illustrating the principle of the embodiments of the disclosure along with the literal description. Apparently, the drawings in the description below are merely some embodiments of the disclosure, a person skilled in the art can obtain other drawings according to these drawings without creative efforts. In the Figures.

DETAILED DESCRIPTION OF PREFERRED EMBODIMENTS

Figure 1:
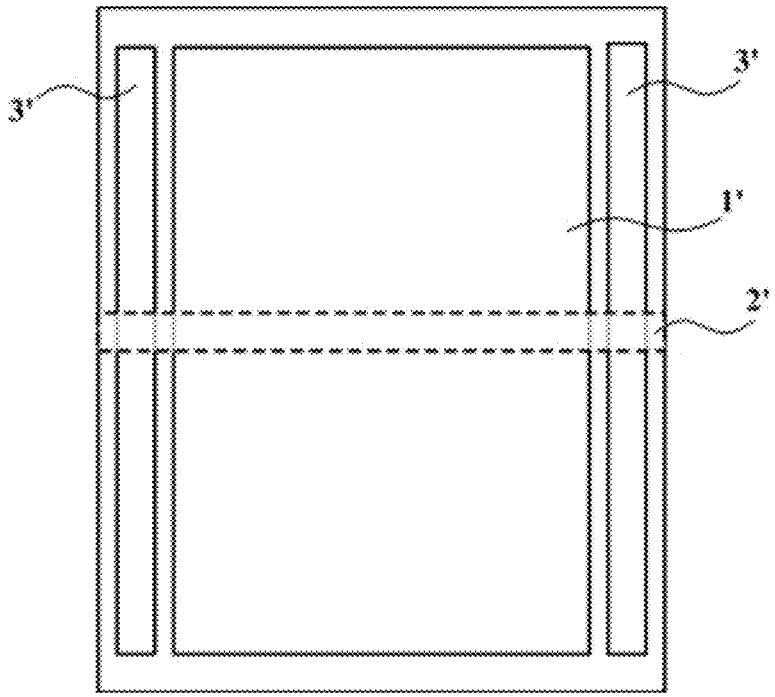
Fig. 1 (Prior Art)
FIG. 1 is a schematic structural diagram of a conventional flexible GOA display panel.

The specific structural and functional details disclosed herein are only representative and are intended for describing exemplary embodiments of the disclosure. However, the disclosure can be embodied in many forms of substitution, and should not be interpreted as merely limited to the embodiments described herein.

In the description of the disclosure, terms such as "center", "transverse", "above", "below", "left", "right", "vertical", "horizontal", "top", "bottom", "inside", "outside", etc. for indicating orientations or positional relationships refer to orientations or positional relationships as shown in the drawings; the terms are for the purpose of illustrating the disclosure and simplifying the description rather than indicating or implying the device or element must have a certain orientation and be structured or operated by the certain orientation, and therefore cannot be regarded as limitation with respect to the disclosure. Moreover, terms such as "first" and "second" are merely for the purpose of illustration and cannot be understood as indicating or implying the relative importance or implicitly indicating the number of the technical feature. Therefore, features defined by "first" and "second" can explicitly or implicitly include one or more the features. In the description of the disclosure, unless otherwise indicated, the meaning of "plural" is two or more than two. In addition, the term "comprise" and any variations thereof are meant to cover a non-exclusive inclusion.

In the description of the disclosure, is should be noted that, unless otherwise clearly stated and limited, terms "mounted", "connected with" and "connected to" should be understood broadly, for instance, can be a fixed connection, a detachable connection or an integral connection; can be a mechanical connection, can also be an electrical connection; can be a direct connection, can also be an indirect connection by an intermediary, can be an internal communication of two elements. A person skilled in the art can understand concrete meanings of the terms in the disclosure as per specific circumstances.

The terms used herein are only for illustrating concrete embodiments rather than limiting the exemplary embodiments. Unless otherwise indicated in the content, singular forms "a" and "an" also include plural. Moreover, the terms "comprise" and/or "include" define the existence of described features, integers, steps, operations, units and/or components, but do not exclude the existence or addition of one or more other features, integers, steps, operations, units, components and/or combinations thereof.

The disclosure will be further described in detail with reference to accompanying drawings and preferred embodiments as follows.

Figure 2:
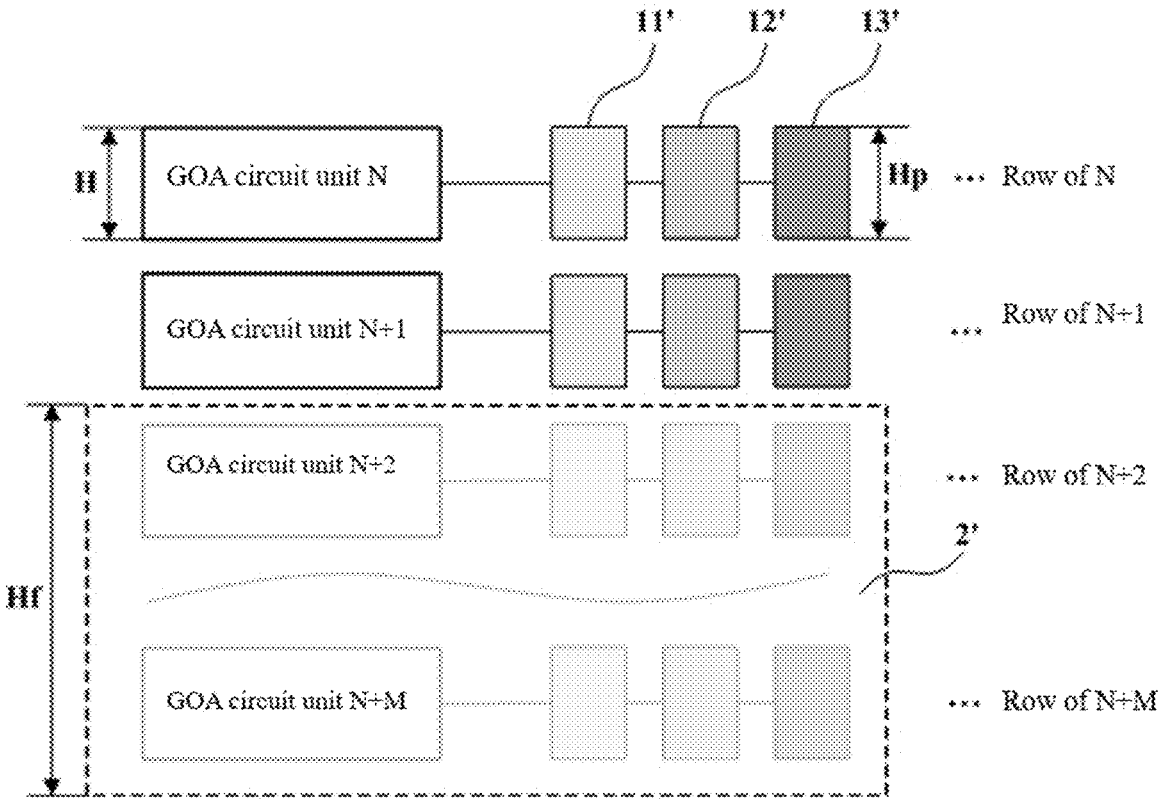
Fig. 2 (Prior Art)
FIG. 2 is a schematic diagram showing the arrangement of the GOA circuit units and the pixels in a conventional flexible GOA display panel.
Figure 3:
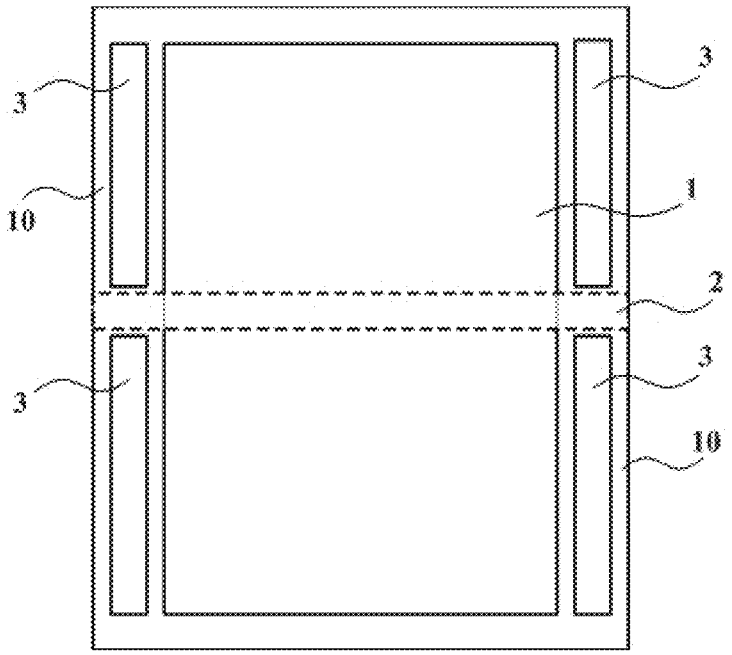
FIG. 3 is a schematic structural diagram of a flexible GOA display panel according to an embodiment of the present invention.

As shown in FIGS. 2 and 3, this embodiment of the present invention provides a flexibly foldable display panel, which comprises a display area 1 having at least one foldable region 2;

multiple rows of pixel units disposed in the display area 1; and multiple GOA circuit units 3 disposed in non-foldable regions 10 on opposite sides of the display area 1, each of the GOA circuit units being used for driving pixel units in a corresponding row; wherein all the GOA circuit units have a same height and the height is smaller than a pixel unit height.

In order to reduce an impact of the foldable regions to the performance of the GOA circuit units in the currently conventional GOA display panel due to stress, and an impact to the life time and production yield of the whole display panel, this embodiment of the present invention provides a new arrangement of the GOA circuit units 3 which is away from the foldable region. In other words, the GOA circuit units 3 are disposed in the non-foldable region 10 at two opposite sides of the display area 1. Moreover, in this embodiment, the arrangement of the pixel units is not changed, and thus the size of the display area 1 remains the same. If it is taken a way only that the GOA circuit units 3 are arranged in the non-foldable region 10 without adjusting their heights, the size of the display panel will undesirably increase under a basis to maintain the size of the display area 1 in equal. Therefore, the height of the GOA circuit unit in the flexible GOA display panel of this embodiment is reduced.

Figure 4:
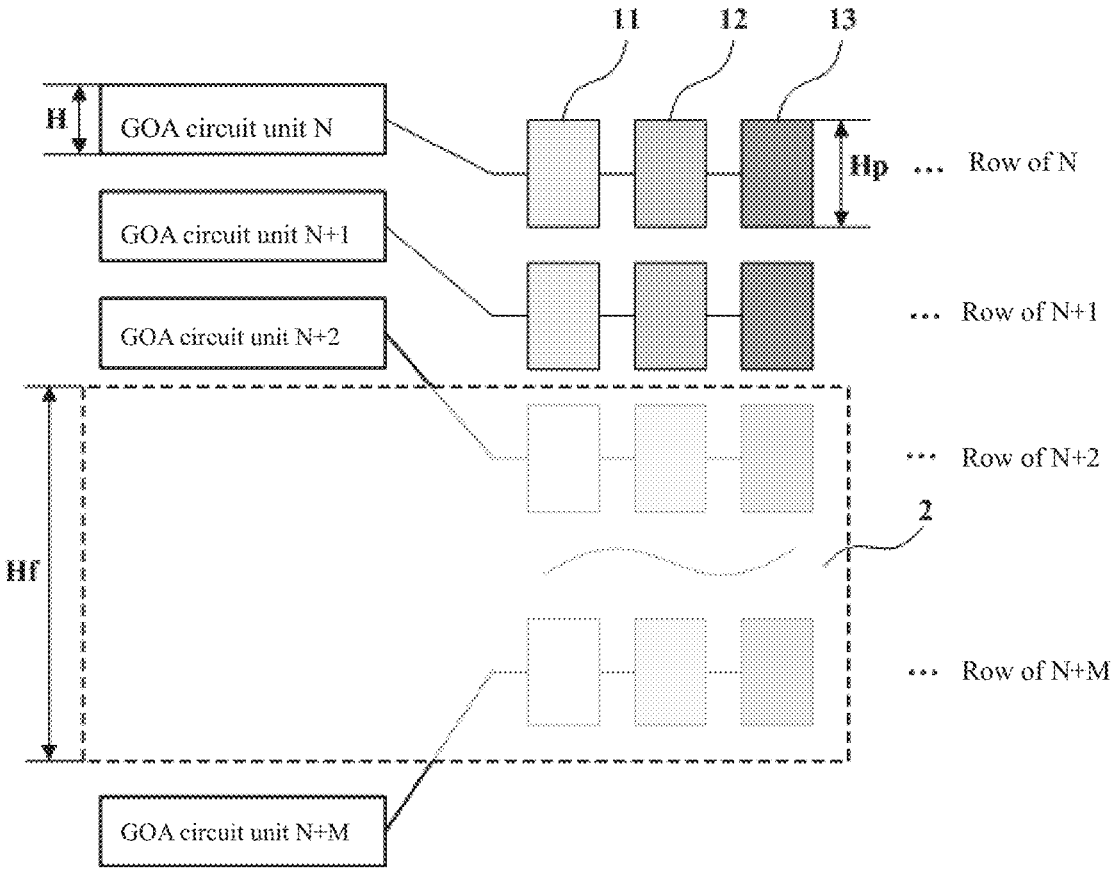
FIG. 4 is a schematic diagram showing the arrangement of GOA circuit units and pixels in a GOA display panel according to an embodiment of the present invention.

Since the GOA unit circuits 3 at all are not distributed in the foldable region 2 and since their corresponding pixel units in each row are continuously distributed in the display area 1 including the foldable region 2, each of the GOA circuit units and the pixel unit in a corresponding row will have an offset in height, and are no longer at a same height as the conventional arrangement shown in FIG. 2. Specifically, as shown in FIG. 4, the display region 1 is provided with rows of pixel units identified from N row to N+m row. Each of the pixel units includes three primary sub-pixels 11, 12, and 13. The pixel units in the row numbers of N and N+1 are located outside the foldable region 2, and the pixel units in the rows of number N+2 to N+m are located within the foldable region 2. However, corresponding GOA circuit units N to N+m for respectively driving the pixel units in the rows of number N to N+m are located outside the foldable region 2.

When the height of the foldable region 2 is Hf, the height of pixel unit is Hp, the resolution of the display panel is a×b, the height of the GOA circuit unit in this embodiment is equal to Hp−Hf/a, wherein a refers to the number of rows of pixel units in the display area 1. In according to conventional technology, however, the height of the conventional GOA circuit unit H is equal to the height of the pixel unit Hp, i.e., H=Hp. In this embodiment, the height of the GOA circuit unit is reduced and the height of the GOA circuit unit H has become H=Hp−Hf/a, i.e., smaller than the height of the pixel unit Hp by Hf/a. By means of that, the total height of all a rows of pixel units is a×Hp. The total height of all the GOA circuit units is a×H=a×(Hp−Hf/a)=a×Hp−Hf. The difference of the above two total heights is the height of the foldable region 1.

Because the height of the GOA circuit unit is reduced, each of the GOA circuit units is not at the same height as the pixel unit in corresponding row, and the lengths of gate lines between the output terminals of respective GOA circuit units and the pixel units in corresponding rows are not the same. In order to avoid disadvantage resulted from this situation, in this embodiment of the present invention, a wiring between the output terminals of respective GOA circuit units and the gate lines of the pixel units in respective corresponding rows is made having an equal resistance. That is, the resistances of the lines between the output terminals of respective GOA circuit units and the gate lines of the pixel units in corresponding lines are equal.

Figure 5:
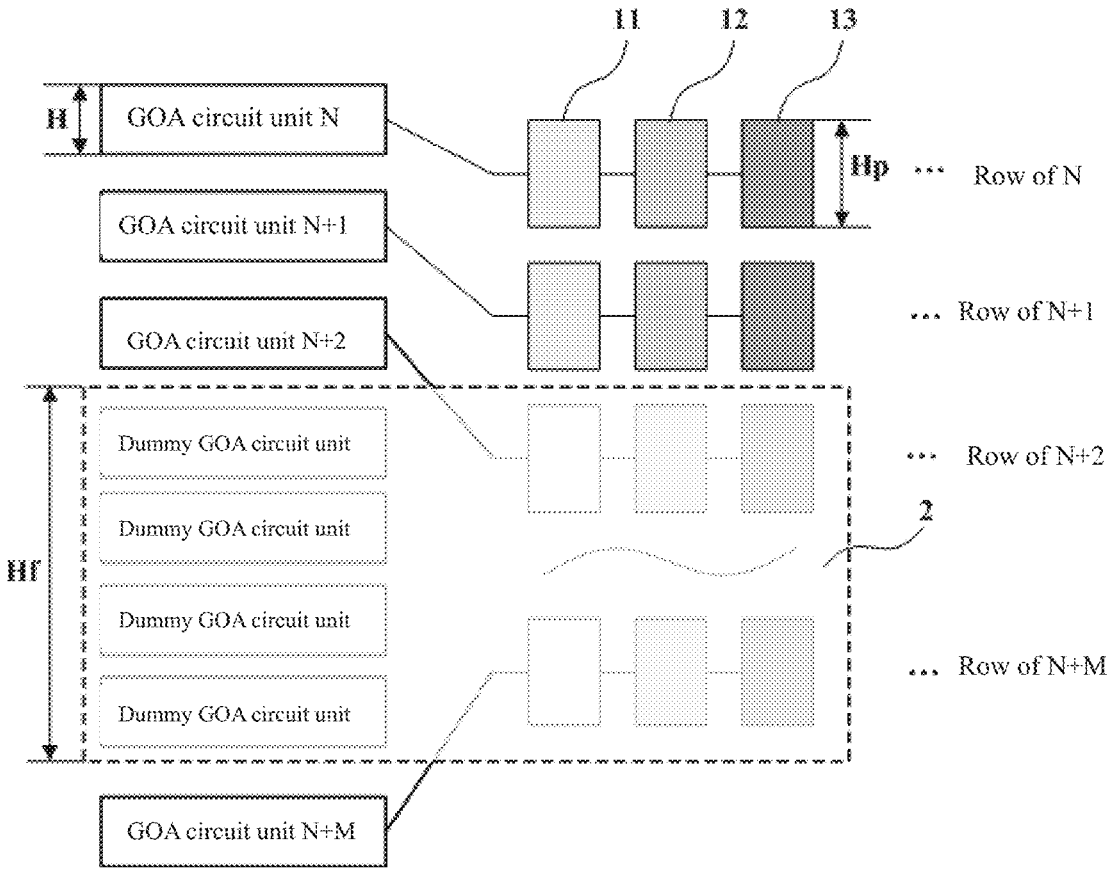
FIG. 5 is another schematic diagram showing the arrangement of GOA circuit units and pixels in a GOA display panel according to another embodiment of the present invention.

Furthermore, since the GOA unit circuit is not disposed in the foldable region 2 in according to this embodiment, an uneven etching is likely to be happened during a manufacturing process. Therefore, as shown in FIG. 5, a plurality of dummy GOA circuit units can be disposed in the foldable region 2 so as to increase the etching uniformity in this area of the GOA circuit units. The height of the dummy GOA circuit unit is equal to the height of the GOA circuit unit.

Figure 6:
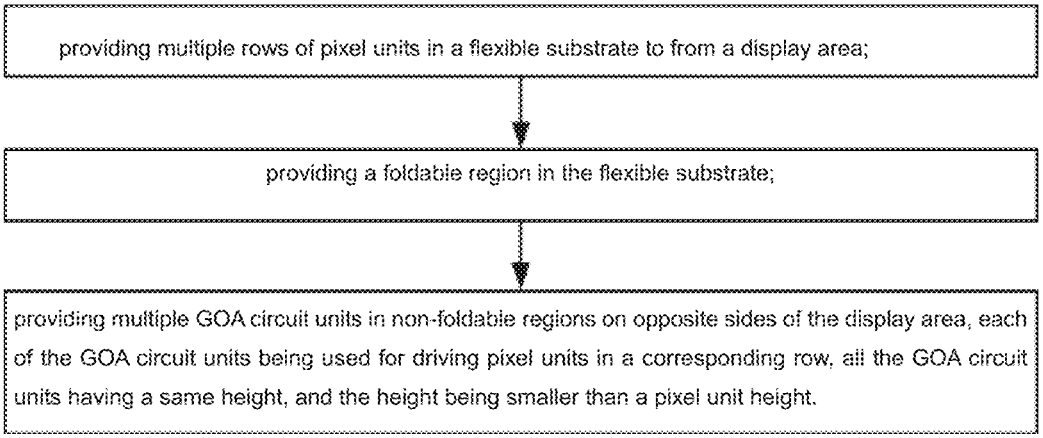
FIG. 6 is a schematic flow chart showing a method for manufacturing a flexible GOA display panel according to a second embodiment of the present invention.

Referring to FIG. 6, a second embodiment of the present invention, corresponding to the first embodiment of the present invention, provides a method of manufacturing a flexible GOA display panel, which includes the steps of:

providing multiple rows of pixel units in a flexible substrate to from a display area;

providing a foldable region in the flexible substrate; and providing multiple GOA circuit units in non-foldable regions on opposite sides of the display area, each of the GOA circuit units being used for driving pixel units in a corresponding row; wherein all the GOA circuit units have a same height and the height is smaller than a pixel unit height.

The height of the GOA circuit unit is equal to Hp−Hf/a, wherein Hf refers to the height of the foldable region, Hp refers to the height of the pixel unit, and a refers to the number of rows of the pixel units in the display area.

The resistances of the lines between the output terminals of respective GOA circuit units and the gate lines of the pixel units in corresponding rows are the same.

The manufacturing method further comprises a step of providing a plurality of rows of dummy GOA circuit units in the foldable region.

The height of the dummy GOA circuit units is equal to the height of the GOA circuit units.

The embodiment provided by the present invention has the following effect. First, the height of the GOA circuit unit is redesigned. The height of conventional GOA circuit unit which is equal to the height of pixel unit has become reduced so that the distribution of the GOA circuit units can be away from the foldable region. Second, the resistances of the lines from the outputs of the GOA circuit units to the pixel units in corresponding rows are the same. The influence of the foldable region to the characteristic and reliability of the whole flexible GOA panel is reduced.

The foregoing contents are detailed description of the disclosure in conjunction with specific preferred embodiments and concrete embodiments of the disclosure are not limited to these description. For the person skilled in the art of the disclosure, without departing from the concept of the disclosure, simple deductions or substitutions can be made and should be included in the protection scope of the application.

What is claimed is:

1. A flexible GOA display panel, comprising:

a display area having at least one foldable region;

multiple rows of pixel units disposed in the display area; and multiple GOA circuit units disposed in non-foldable regions on opposite sides of the display area, each of the GOA circuit units being used for driving pixel units in a corresponding row; wherein all the GOA circuit units have a same height and the height is smaller than a pixel unit height.

2. The flexible GOA display panel as claimed in claim 1, wherein the height of the GOA circuit unit is equal to Hp−Hf/a, and wherein Hf refers to the height of the foldable region, Hp refers to the height of the pixel unit, and a refers to the number of rows of the pixel units in the display area.

3. The flexible GOA display panel as claimed in claim 1, wherein the resistances of the lines between the output terminals of respective GOA circuit units and the gate lines of the pixel units in corresponding rows are the same.

4. The flexible GOA display panel as claimed in claim 1, wherein the foldable region is provided with a plurality of rows of dummy GOA circuit units.

5. The flexible GOA display panel as claimed in claim 4, wherein the height of the dummy GOA circuit unit is equal to the height of the GOA circuit unit.

6. A method of manufacturing a flexible GOA display panel, comprising steps of:

providing multiple rows of pixel units in a flexible substrate to from a display area;

providing a foldable region in the flexible substrate; and providing multiple GOA circuit units in non-foldable regions on opposite sides of the display area, each of the GOA circuit units being used for driving pixel units in a corresponding row; wherein all the GOA circuit units have a same height and the height is smaller than a pixel unit height.

7. The manufacturing method as claimed in claim 6, wherein the height of the GOA circuit unit is equal to Hp−Hf/a, wherein Hf refers to the height of the foldable region, Hp refers to the height of the pixel unit, and a refers to the number of rows of the pixel units in the display area.

8. The manufacturing method as claimed in claim 6, wherein the resistances of the lines between the output terminals of respective GOA circuit units and the gate lines of the pixel units in corresponding rows are the same.

9. The manufacturing method as claimed in claim 6, further comprising a step of providing a plurality of rows of dummy GOA circuit units in the foldable region.

10. The manufacturing method as claimed in claim 9, wherein the height of the dummy GOA circuit unit is equal to the height of the GOA circuit unit.

* * * * *